US006616354B2

(12) United States Patent
O'Hara et al.

(10) Patent No.: US 6,616,354 B2
(45) Date of Patent: Sep. 9, 2003

(54) METHOD AND APPARATUS FOR ADJUSTING PRINTHEAD TO PRINT-MEDIA TRAVEL PATH SPACING IN A PRINTER

(75) Inventors: Kevin D. O'Hara, Washougal, WA (US); Walker M. Beckman, Vancouver, WA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/020,539

(22) Filed: Oct. 30, 2001

(65) Prior Publication Data

US 2003/0079625 A1 May 1, 2003

(51) Int. Cl.[7] ..... B41J 25/308

(52) U.S. Cl. ..... 400/56; 400/59; 400/352; 400/354

(58) Field of Search ..... 400/55, 56, 57, 400/58, 59, 352, 354

(56) References Cited

U.S. PATENT DOCUMENTS

| | | | | | |
|---|---|---|---|---|---|
| 4,879,566 | A | * | 11/1989 | Hanabusa | 347/198 |
| 5,156,466 | A | * | 10/1992 | Inagaki et al. | 400/56 |
| 5,193,918 | A | * | 3/1993 | Lohrmann et al. | 400/56 |
| 5,257,867 | A | * | 11/1993 | Ito et al. | 400/56 |
| 5,455,607 | A | * | 10/1995 | Rhoads et al. | 347/8 |
| 6,059,468 | A | * | 5/2000 | Haug | 400/56 |
| 6,524,021 | B2 | * | 2/2003 | Johnson et al. | 400/354 |

* cited by examiner

*Primary Examiner*—Andrew H. Hirshfeld
*Assistant Examiner*—Dave A. Ghatt

(57) ABSTRACT

Apparatus for adjusting the spacing in a printer between a printhead and the travel path for print media which moves through the printer. The printhead is borne by a carriage which is rotatably mounted adjacent an elongate bearing rail wherein the rotated condition of the carriage relative to that rail establishes the desired spacing. First and second relative moveable bearing structures mounted on the carriage include bearing surfaces which can alternatively adjust the bearing structures so that one or the other, but not both, determine the rotated condition of the carriage.

15 Claims, 3 Drawing Sheets

METHOD AND APPARATUS FOR ADJUSTING PRINTHEAD TO PRINT-MEDIA TRAVEL PATH SPACING IN A PRINTER

TECHNICAL FIELD

This invention relates to printers, and in particular, to a method and apparatus for adjusting the position of a printhead in a printer relative to different-thickness print media.

BACKGROUND AND SUMMARY OF THE INVENTION

A typical inkjet printer includes one or more print cartridges which include printheads through which ink is ejected as the cartridges reciprocate across a print-medium travel path along which various print media travel through the printer. In most conventional printing situations, such print media typically includes both conventional plain paper having one thickness, and envelopes having a slightly greater thickness. In order to achieve crisp, high-quality printing, without smearing, which can occur if a printhead touches or comes too close to underlying print media, it is important that the spacing between the printhead and the surface of the underlying media have a certain predetermined spacing. Where media differing in thickness are to be handled (and such is usually the case, for example, where conventional single-sheet paper and thicker envelopes are printed upon), a single, fixed printhead to travel-path spacing is not ideal. Such a spacing typically defers to the expected greater-thickness envelope media, and this deference comprises print quality and crispness for thinner single-sheet paper media.

DISCLOSURE OF THE INVENTION

The present invention provides apparatus for adjusting the spacing in a printer between a printhead and the travel path for print media which moves through the printer. The printhead is borne by a carriage which is rotatably mounted adjacent an elongate bearing rail wherein the rotated condition of the carriage relative to that rail establishes the desired spacing. First and second relative moveable bearing structures mounted on the carriage include bearing surfaces which can alternatively adjust the bearing structures so that one or the other determine the rotated condition of the carriage

DETAILED DESCRIPTION OF THE PREFERRED EMBODIMENT AND BEST MODE OF CARRYING OUT THE INVENTION

According to the structure and practice of the present invention as such is disclosed herein, the carriage structure which carries print cartridges in a printer is equipped with two different bearing-surface structures, one of which possesses a fixed-position bearing surface relative to the carriage, and the other of which possesses a moveable-position beam surface relative to the carriage. These bearing surfaces trade back and forth, in a mutually exclusive manner (and as called for, depending on the particular thickness of media being handled at a particular time), the responsibility of riding against an elongate bearing rail which parallels the reciprocable direction of carriage motion during a printing operation. These specific bearing-surface/bearing-rail engagements define two angular dispositions for the carriage relative to a carriage rail which support the carriage for both reciprocation and angulation within the printer. In turn, these two different angular dispositions create two different printhead to media travel-path spacings, which spacings lead to good quality printing in the differentiated single-sheet/envelope printing activities mentioned above.

The position of the moveable bearing surface is shifted in one direction (i.e., the direction which places this surface effectively in command of the carriage's angular position to increase the subject spacing) by momentary energization of a shape memory alloy. Such energization takes place either by specific user action, or as a result of automatic sensing of print media thickness. Return shifting of this moveable bearing surface, to the nominal condition wherein the fixed bearing surface dominates (and defines the subject spacing) takes place on the occurrence of the carriage returning to what is referred to as its home position in the printer, wherein a reset component mechanically initiates the change.

Figure 1:
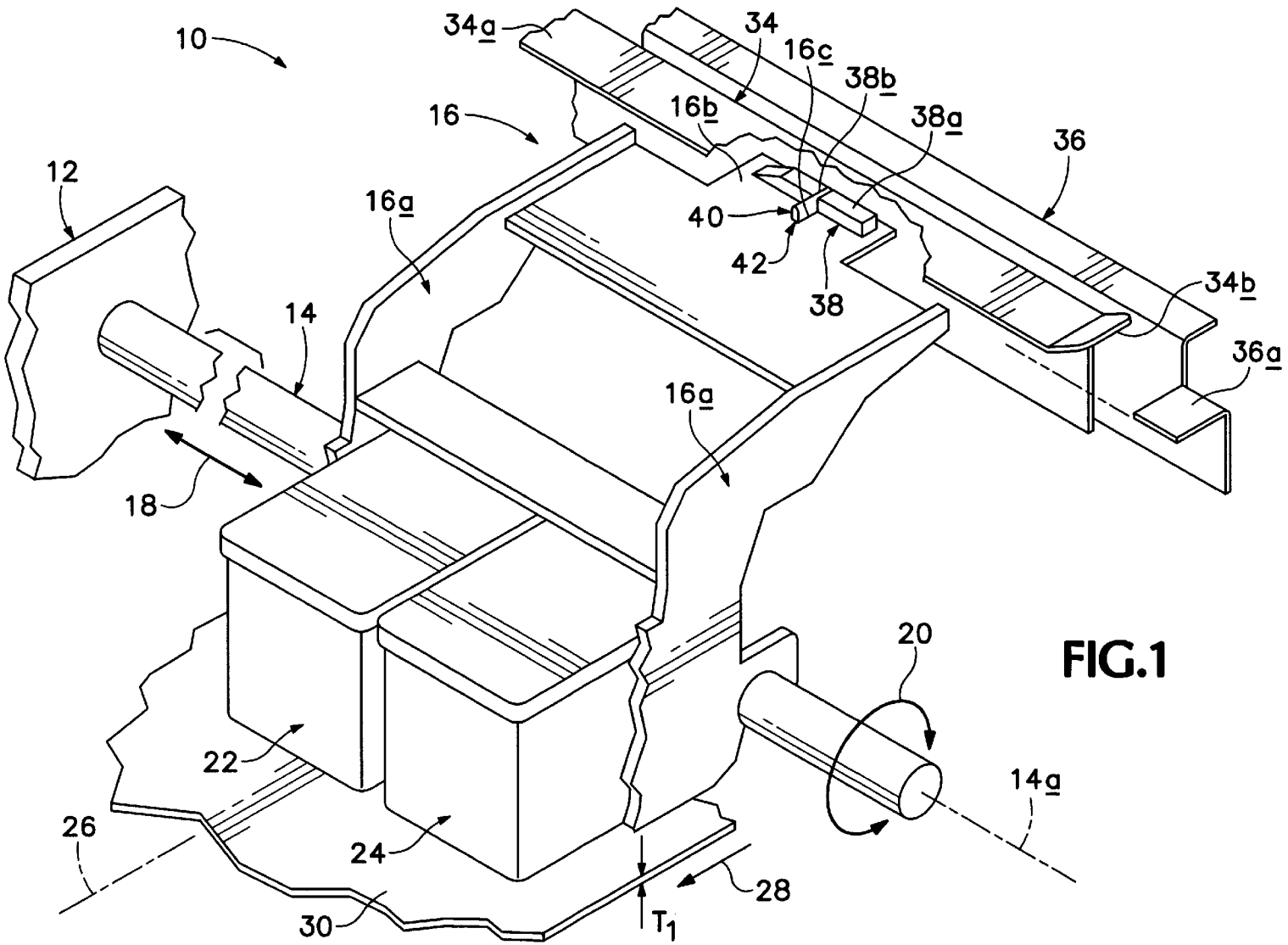
FIG. 1 is a fragmentary isometric view illustrating a printer with a print-cartridge-carrying carriage whose angular position, during a printing operation is controlled in accordance with practice and the structure of an embodiment of the present invention so as to adjust printhead to print-media travel-path spacing.
Figure 2:
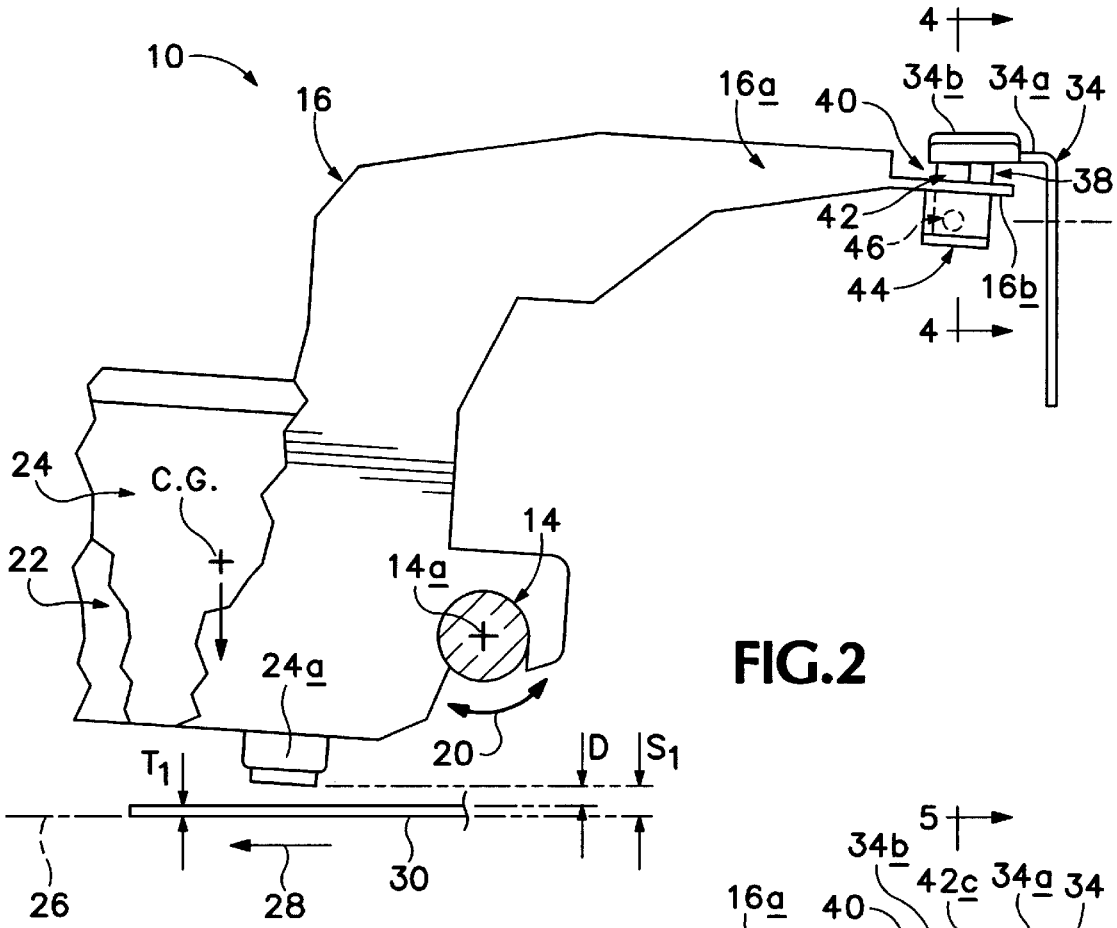
FIG. 2 is a fragmentary, side elevation taken generally from the lower right side of FIG. 1 illustrating the carriage in the printer of FIG. 1 in a default angular condition in the printer, wherein printhead to print-media travel-path spacing, is at a minimum.
Figure 3:
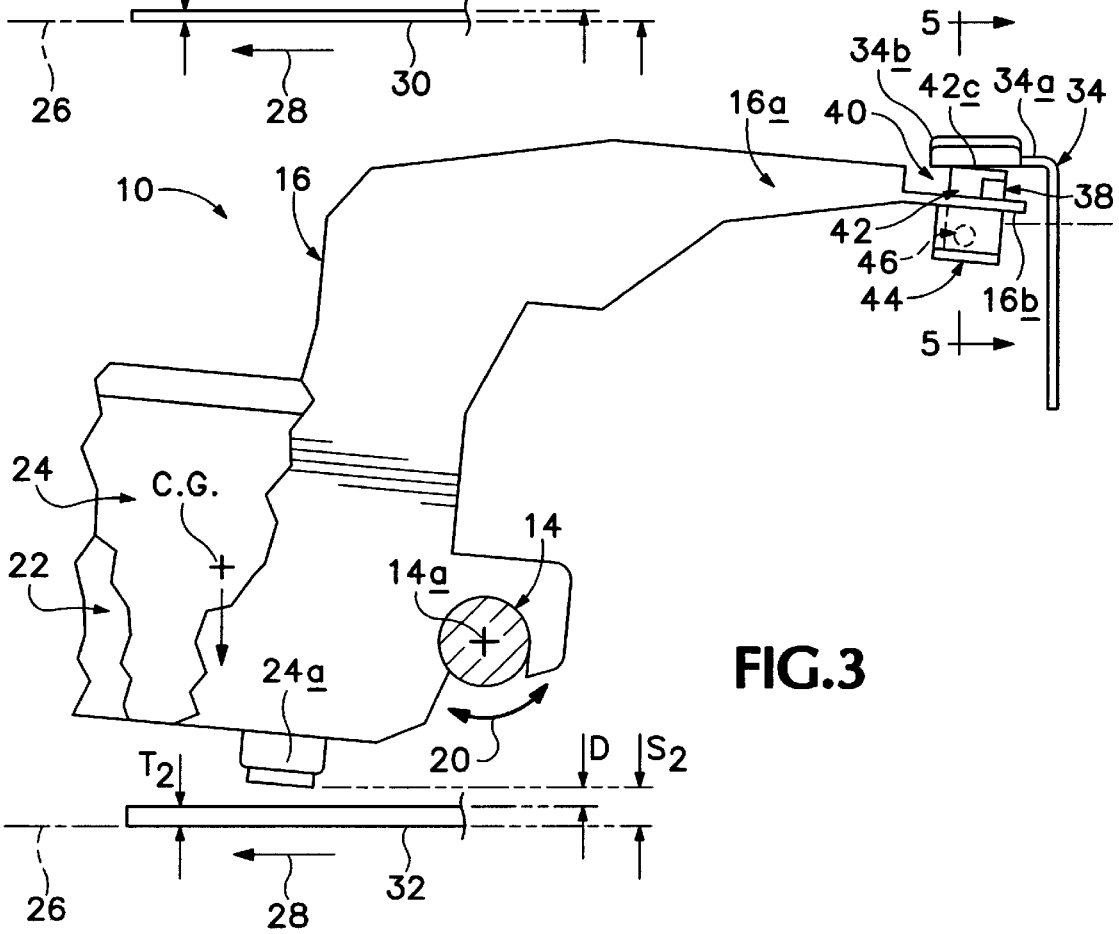
FIG. 3 is like FIG. 2, except that here the components are illustrated with the carriage adjusted according to practice of the invention to another angular condition, wherein printhead to print-media travel-path spacing, is greater.

Turning attention now to the drawings, and referring first to FIGS. 1–3, inclusive, indicated generally and fragmentarily at 10 is an inkjet printer which is constructed in accordance with the present invention with apparatus to permit selective adjustment of printhead to print-media travel-path spacing. The far side of the frame in printer 10 is shown fragmentarily at 12 in FIG. 1, and suitably extending laterally between the opposite sides of this frame is an elongate, generally cylindrical carriage rail 14 which supports a print-cartridge-carrying carriage 16 in the printer.

Carriage rail 14 has a long axis indicated by dash-dot line 14*a* in FIG. 1, and the carriage rail specifically supports carriage 16 for motor-driven reciprocation (during printing) along the carriage rail as illustrated by double-ended, straight arrow 18. Rail 14 also supports the carriage for angular rocking, or rotation, reversibly about axis 14*a*, as illustrated by double-ended, curved arrows 20 in FIGS. 1, 2 and 3.

Suitably and conventionally mounted on and carried by carriage 16 are plural print cartridges, such as the two shown at 22, 24 in FIGS. 1, 2 and 3. Each of these cartridges includes a conventional inkjet printhead, such as printhead 24*a* which is seen in FIGS. 2 and 3 on cartridge 24. With lateral reciprocal shifting of carriage 16 during a printing operation, the printheads move closely overhead the upper surface of whatever print medium happens to be traveling through the printer along the nominal print-media travel path (or plane), represented by dash-dot line 26. Print-media travel direction is indicated by arrow 28 in FIGS. 1, 2 and 3. As discussed herein, it will be appreciated that carriage 16 may be a separate structure carrying a print cartridge or print cartridges, or may itself be a pen, print cartridge, etc.

In FIGS. 1 and 2, conventional, single-sheet paper stock 30 is shown traveling along path 26, the paper having the thickness shown at $T_1$. In FIG. 3, conventional envelope stock 32 is shown traveling along path 26, the envelope having a greater thickness indicated at $T_2$.

Carriage 16 includes an extension 16*a* which is referred to generally as an anti-rotation arm. Arm 16*a* extends upwardly and to the right of rail 14 as seen in FIGS. 1, 2 and 3. The outer extremity of arm 16*a* include a platform extension 16*b* (the purpose for which will be described shortly) which is disposed beneath a horizontal, planar flange 34*a* in an elongate, fixed, anti-rotation bearing rail 34. Formed in flange 34*a* near the end thereof which is toward the viewer in FIG. 1 is an angularly upwardly inclined portion 34*b*, the function of which will be discussed shortly. Rail 34 substantially parallels rail 14, and is anchored to the frame in printer 10 through an anti-rotation mount 36 which has the configuration generally pictured for it in FIG. 1. Included in mount 36, adjacent the end of rail 34 which is generally toward the viewer in FIG. 1, is a short, horizontal, planar flange 36*a* which constitutes what is referred to herein as a reset component in printer 10. Flange 36*a* lies in a plane which substantially parallels the plane of rail flange 34*a*, with the plane of flange 36*a* lying a short distance below the plane of flange 34*a*. The region in printer 10 which is adjacent flange 36*a* constitutes a home position for carriage 16.

Platform extension 16*b* carries, as will now be described, two different, relatively moveable bearing structures that form parts of the spacing adjustment apparatus provided in printer 10 according to the present invention. Referring now to all of the drawing figures herein, these two bearing structures include a first, or primary, relatively moveable bearing structure 38, and a second, or secondary, relatively moveable bearing structure 40. As will become apparent, bearing structures 38, 40 include components which can move relative to one another. Bearing structure 38 is fixed relative to carriage 16, and bearing structure 40 is moveable relative to the carriage.

Primary bearing structure 38 takes the form of an elongate raised island having an upper surface 38*a* which constitutes a bearing surface in structure 38. It also includes a slot 38*b* which extends generally in a vertical plane downwardly through the bearing structure to communicate with another slot 16*c* that is formed in platform 16*b*.

Bearing surface 38*a* functions herein to define the nominal or default angular position, or disposition, of the carriage relative to rail axis 14*a*. It does so by bearing against the undersurface of rail flange 34*a*. This bearing arrangement, and angular nominal position-defining for the carriage (and thus for the print cartridges and the printheads), comes about under the influence of gravity which acts on the assembly of the carriage and print cartridges generally at the location shown at CG in FIGS. 2 and 3. Thus, gravity tends to urge counterclockwise rotation of the carriage in FIGS. 1, 2 and 3 about axis 14*a*, which rotation stops, normally in the default condition for the carriage, with bearing surface 38*a* engaged with the undersurface of rail 34*a*. This condition of engagement is pictured clearly in FIGS. 2 and 4. As was mentioned earlier, bearing structure 38, and its bearing surface 38*a*, occupy fixed positions in the overall structure of carriage 16.

With bearing surface 38*a* so-engaging rail flange 34*a*, and with carriage 16 and the print cartridges occupying the angular positions generally illustrated in FIG. 2, the lower extremity of the printheads (see printhead 24*a*) lie at a nominal or default spacing, indicated at $S_1$, above plane 26—the support plane for the transport of print media through the printer. It is this spacing which is referred to herein as the printhead to print-media travel-path spacing. As can be seen in FIG. 2, under these circumstances, a conventional single sheet of paper, such as paper sheet 30, has an upper surface lying generally at a distance D (see FIG. 2) relative to the underside of the printheads. Spacing D has been chosen, of course, to furnish an appropriate spacing for the application of ink to the surface of print media, such as to the surface of paper sheet 30.

Secondary bearing structure 40 takes the form of a vertically reciprocable (moveable) plunger 42. Plunger 42 includes a lower portion 42*a* that resides below platform 16*b*, a thin, blade-like upper portion 42*b* which extends slidably upwardly through previously-mentioned slots 38*b*, 16*c*, and an elongate, rounded, upper bearing surface 42*c* formed on the upper edge of upper portion 42*b*. The lower part of lower portion 42*a* includes a cam surface 42*d*. Portions 42*a* and 42*b* join through an upwardly facing, generally horizontal shoulder 42*e*.

Cooperating with bearing structure 40 is actuator structure including a moveable slider 44, and an elongate, conventional shape memory alloy device, or motion element, 46. Slider 44 has the side profile generally pictured in FIGS. 4–6, inclusive, and specifically includes an upwardly facing cam surface 44*a*. To the left on that surface is what is referred to herein as a plunger retention well 44*b*. The slider is appropriately mounted on the underside of platform 16*b* for reciprocation back and forth to the left, and to the right, as pictured in FIGS. 4, 5 and 6.

Shape memory alloy device 46, which is a device that is energized electrically and momentarily (as will shortly be described) to shift the slider in one particular direction, has one of its ends pinned at 48 to the slider, and its opposite end pinned at 50 appropriately to carriage structure which lies beneath platform 16*b*. Pin 50 is received slidably in an elongate slot 44*c* formed (as illustrated in FIGS. 4, 5 and 6) in slider 44.

Figure 4:
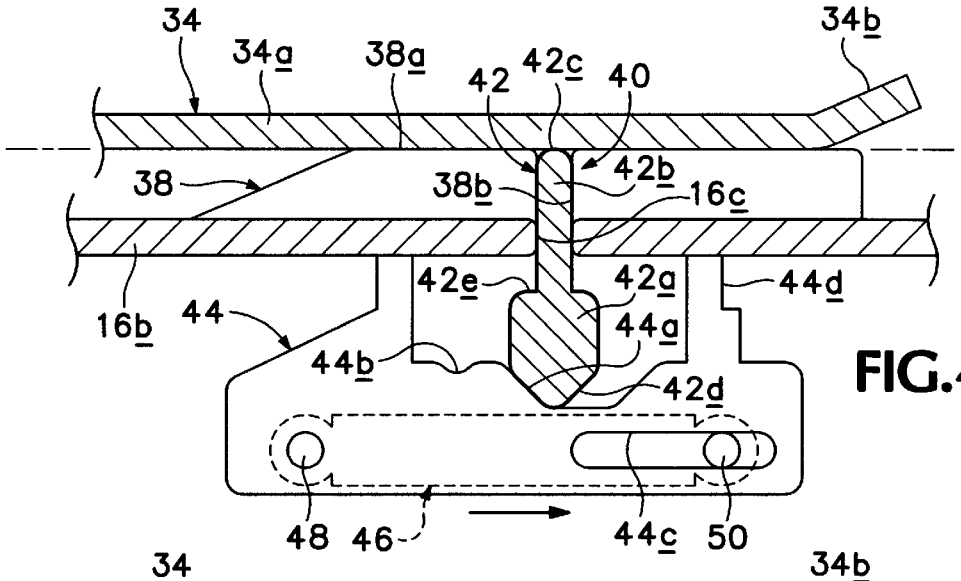
FIG. 4 is an enlarged, fragmentary view taken generally along the line 4—4 in FIG. 2 illustrating fixed and relatively moveable bearing surface structures, and actuation structure for the latter, constructed in accordance with an embodiment of the present invention, and with these components illustrated in the respective relative positions that they occupy with the carriage in the printer is angulated as illustrated in FIG. 2.

FIG. 4 in the drawings generally illustrates the relative positions of the various parts in the two bearing structures, and in the actuator structure, under circumstances where the angular conditions of the carriage (relative to axis 14*a*) is the default condition. In this condition, bearing surface 38*a* engages the underside of rail flange 34*a*, plunger 42 is positioned in what is referred to herein as a non-operative condition, with its bearing surface lying at or slightly below the plane of surface 38*a*. The slider and shape memory alloy are disposed generally as shown in FIG. 4. So long as this arrangement of relative positions remains, the carriage stays in its nominal (or default) angular condition in the printer, with the printheads spaced relative to path 26 as pictured in FIG. 2.

Figure 5:
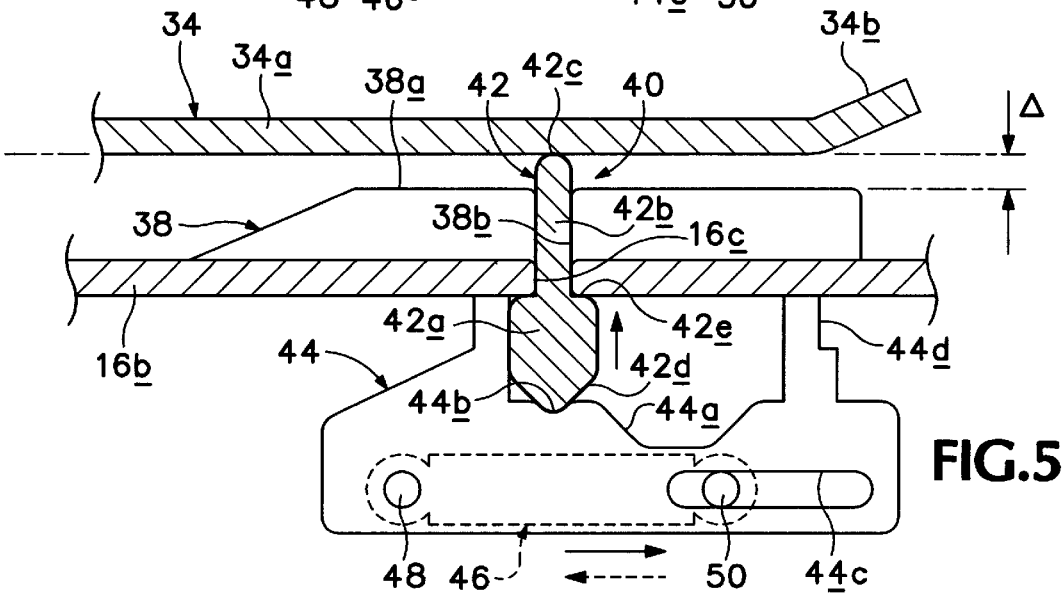
FIG. 5 is an enlarged fragmentary view taken generally along the line 5—5 in FIG. 3 illustrating the same componentry pictured in FIG. 2, but here showing this componentry in relative positions which they occupy with the carriage angulated as pictured in FIG. 3 to establish a greater printhead to print-media travel-path spacing than that which is illustrated in FIG. 2.
Figure 6:
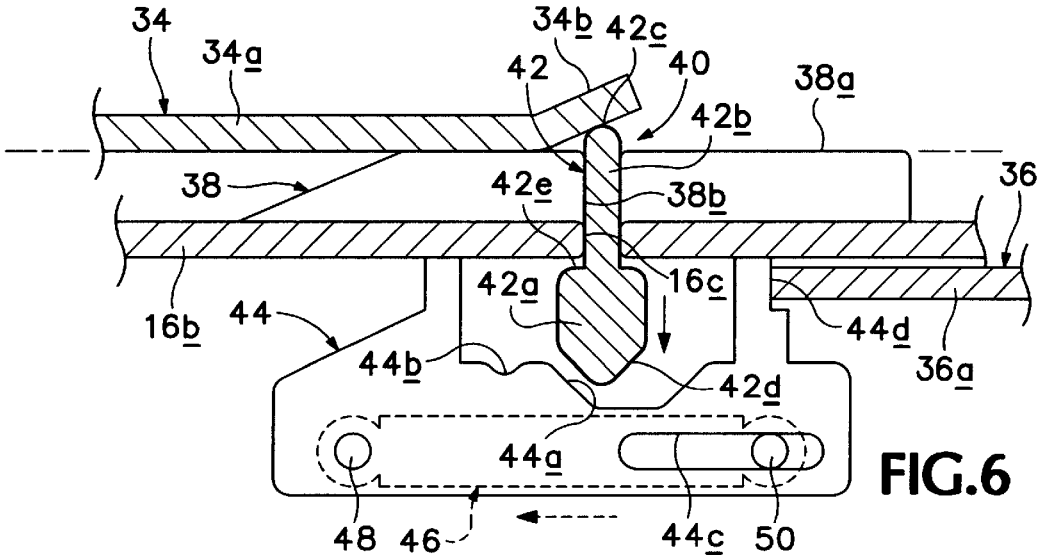
FIG. 6 is a view which is somewhat similar to those presented in FIGS. 4 and 5, but here illustrating the conditions of these components under circumstances where the carriage has returned to its home position in the printer so as to effect a return of the two mentioned bearing surface structures generally to the relative conditions therefor pictured in FIG. 4.

When it is desired to accommodate print media having a greater thickness than that of paper 30 (such as the greater thickness which characterizes envelope 32 seen in FIG. 3), either by appropriate user signaling, or, if desired, by automatic sensing of media thickness, a momentary electrical pulse energizes the shape memory alloy device, which device then rapidly contracts to a condition like that shown in FIG. 5. Such a contraction rapidly draws slider 44 to the right in FIGS. 4 and 5, with cam surfaces 44*a*, 42*d* engaging to drive plunger 42 upwardly in slots 34*b*, 16*c*, and into what is referred to herein as a deployed condition. This activity is performed under circumstances where bearing surface 42*c* underlies rail flange 34*a*, and under this condition, bearing surface 42*c* effectively takes over and dominates, from bearing surface 38*a*, control of the angular position of the carriage and print cartridges relative to rail axis 14*a*.

FIG. 5 clearly illustrates this condition, where one can see that bearing surface 42*c* now engages the underside of rail flange 34*a*, with a spacing Δ now existing between the underside of rail flange 34*a* and bearing surface 38*a*. The bottom of the lower portion 42*b* of plunger 42 seats in retention well 44*b*. Such seating, together with forces introduced into the system by gravity relative to carriage 16, causes the slider bearing surface 42*c* and rail flange 34*a* to hold fast generally in the conditions illustrated in FIG. 5. The shape memory alloy, once de-energized, plays no role in retaining these positions.

When this deployment activity occurs, the carriage is effectively rocked in a clockwise direction as such is pictured in FIGS. 2 and 3, with the creation of spacing Δ (mentioned above) causing the printheads to rise to a greater distance above print-media support plane 26. This greater distance is shown at $S_2$ in FIG. 3, and is referred to herein as a larger or greater printhead to print-media travel-path spacing. Preferably, this change to spacing $S_2$ creates essentially the same distance D between the undersides of the printheads, and the upper surfaces of the thicker print media now to travel beneath the printheads.

This condition of raised printheads continues until the printing operation which has called for the raised condition has been completed, and the carriage has returned to its home position. On return of the carriage to this home position, flange 36*a* (the reset component in printer 10), engages a surface (resent portion) 44*d* in slider 44, as shown in FIG. 6, to cause the slider to shift relative to platform 16*b* so as to return it essentially to the position shown for the slider in FIG. 4. This conditions allows for a gravity return, nominally, of plunger 42 to a condition with bearing surface 42*c* once again at or below the plane of bearing surface 38*a*, whereupon bearing surface 38*a* again dominates, and defines again the nominal or default angular condition for the carriage first described. Previously mentioned flange portion 34*b* assures return of plunger 42 to a lowered condition in the event that the plunger does not drop by gravity to the desired lowered condition. This assurance takes place when the carriage is once again moved outwardly of the home position along rail 14 to initiate a new printing operation for single-sheet, thin media.

INDUSTRIAL APPLICABILITY

Printers and computer systems typically employ printhead-carrying carriages that reciprocate during a printing operation, and which are angularly rockable to accommodate different thicknesses of print media by adjusting printhead to print-media travel-path spacing. The invention proposes very simple and reliable apparatus, and a related method, involving bearing structures which are selectively and relatively adjustable in relation to a fixed bearing rail in a printer to create different specific mutually exclusive spacings of the category mentioned. Adjustments may be implemented by user selection, or by print-media thickness sensing, and via differentially employed electromechanical or simply mechanical mechanisms that are engageable with the bearing structures.

We claim:

1. Apparatus for adjusting the spacing in a printer between a printhead and the travel path for print media that moves through the printer, wherein the printhead is borne by a carriage that is rotatably mounted in the printer adjacent an elongate, engageable bearing rail, and wherein the rotated condition of the carriage relative to that rail establishes such spacing, the apparatus comprising:

first and second relatively moveable bearing structures mounted on the carriage, each including a bearing surface which is moveable relative to the bearing surface in the other bearing structure, the bearing surfaces, as a result of defined relative movement occurring therebetween, selectively engaging the bearing rail to establish two, different, related, rotated conditions of the carriage; and actuator structure mounted on the carriage and operatively associated with the bearing structures, operable to produce such defined relative movement.

2. The apparatus of claim 1, wherein one of the bearing structures includes a moveable plunger, and the actuator structure includes a moveable slider with a cam surface which is operatively engageable/disengageable with, and reversibly shiftable relative to, the plunger to effect movement of the plunger selectively into first and second different positions which are associated respectively with the mentioned first and second different rotated conditions of the carriage.

3. The apparatus of claim 2, wherein the actuator structure further includes a shape memory alloy drivingly interposed the slider and the carriage.

4. The apparatus of claim 2, wherein the carriage has a home position relative to the bearing rail, the printer includes a reset component disposed near that home position, and the slider includes a reset portion that engages the reset component when the carriage moves into the home position, thus to assure placement of the carriage by default in one of such two rotated conditions of the carriage.

5. The apparatus of claim 2, wherein one of the bearing structures includes a slot opening to the bearing surface of such bearing structure, the other bearing structure includes a moveable plunger that is reversibly moveable in the opening, and the actuator structure includes a moveable slider with a cam surface which is operatively engageable and disengageable with the plunger for effecting movement thereof, and a shape memory alloy drivingly interposed the carriage and the slider to move the slider relative to the carriage.

6. Apparatus for adjusting the printhead to print-media travel-path spacing in a printer having a moveable printhead carriage which is mounted for rotation in a manner that accommodates a change in such spacing, and wherein the carriage carries a first bearing structure having a first bearing surface that nominally engages a fixed rail to define one such spacing, the apparatus comprising:

a plunger mounted for movement on the carriage adjacent the first bearing structure, the plunger including a second bearing surface which is selectively shiftable between a nonoperative condition and a deployed condition relative to the first bearing surface of the first bearing structure; and actuator structure associated with interposed the carriage and the plunger, operable to move the plunger so as to shift the second bearing surface from the nonoperative condition to the deployed condition, wherein the second bearing surface engages the rail in lieu of the first bearing surface, such engagement producing rotation of the carriage to establish a changed printhead to print-media travel-path spacing.

7. The apparatus of claim 6, wherein the actuator structure includes a moveable slider with a cam surface that is operatively engageable and disengageable with the plunger to define, selectively, the deployed condition and the nonoperative condition, respectively, of the second bearing surface.

8. The apparatus of claim 7, wherein the actuator structure further includes a shape memory alloy operatively interposed the carriage and the slider, operable to move the slider, and thereby the engaged plunger.

9. The apparatus of claim 7, wherein the carriage has a home position, and adjacent one end of the rail in the printer, there is a reset component which is operatively engageable with a reset portion of the slider when the carriage moves into the home position, thus to establish a position for the slider that accommodates positioning of the plunger so as to locate the second bearing surface in the nonoperative condition.

10. The apparatus of claim 7, wherein the slider includes a plunger-retention well that tends to hold and stabilize the plunger releasably in a position relative to the slider wherein the second bearing surface remains in a deployed condition.

11. A method of determining and adjusting the printhead to print-media travel-path spacing in a printer comprising:

supporting the printhead on a carriage which can be rocked to change printhead to print-media travel-path spacing;

furnishing on the carriage plural, different bearing structures which are selectively moveable relative to one another to engage an adjacent bearing rail in the printer, thus to define different rocked conditions of the carriage, and hence different printhead to print-media travel-path spacings; and selectively moving the bearing structures.

12. The method of claim 11, wherein furnishing of the bearing structures includes forming one such surface on a moveable plunger, and wherein selective moving the bearing structures includes moving the plunger.

13. The method of claim 12, further comprising disposing adjacent the plunger a bidirectionally shiftable slider having a drive cam surface which is adjacent and in contact with the plunger, and shifting the slider to move the plunger via interengagement of the plunger with the cam surface.

14. The method of claim 13, further comprising shifting the slider, at least in one direction, by actuation of an electrically energized motion element.

15. The method of claim 14, further comprising defining a home position in the printer for the carriage, locating a reset component in the vicinity of that home position, and disposing the slider on the carriage in such a fashion that the slider engages the reset component when the carriage moves into the home position, thus to shift the slider in a direction which is opposite the mentioned at least one direction.

* * * * *